US008183785B2

(12) United States Patent
Boleko Ribas et al.

(10) Patent No.: US 8,183,785 B2
(45) Date of Patent: May 22, 2012

(54) METHOD OF CONTROLLING A LIGHTING SYSTEM BASED ON A TARGET LIGHT DISTRIBUTION

(75) Inventors: Salvador Expedito Boleko Ribas, Aachen (DE); Volkmar Schulz, Wuerselen (DE); Dirk Valentinus Rene Engelen, Heusden-Zolder (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 723 days.

(21) Appl. No.: 12/303,753

(22) PCT Filed: Jun. 18, 2007

(86) PCT No.: PCT/IB2007/052323

§ 371 (c)(1),
(2), (4) Date: Dec. 8, 2008

(87) PCT Pub. No.: WO2008/001259

PCT Pub. Date: Jan. 3, 2008

(65) Prior Publication Data

US 2010/0235309 A1 Sep. 16, 2010

(30) Foreign Application Priority Data

Jun. 28, 2006 (EP) ..... 06116229

(51) Int. Cl.
*H05B 37/00* (2006.01)

(52) U.S. Cl. ..... 315/149; 315/158; 315/294; 315/312

(58) Field of Classification Search ..... 315/291, 315/312, 307, 308, 309, 294, 295, 296, 297, 315/314, 315, 316, 320, 321, 149, 156, 159, 315/157, 158

See application file for complete search history.

(56) References Cited

U.S. PATENT DOCUMENTS

2002/0015097 A1 2/2002 Martens et al.

(Continued)

FOREIGN PATENT DOCUMENTS

JP 05191825 A 7/1993

OTHER PUBLICATIONS

Gaurav Sharma et al; "Digital Color Imaging", IEEE Transactions on Image Processing, IEEE Service Center, Pisctaway, NJ, US, vol. 6, No. 7, pp. 901-932, Jul. 1997, XP011026182.

(Continued)

*Primary Examiner* — David Hung Vu
(74) *Attorney, Agent, or Firm* — Mark L. Beloborodov

(57) ABSTRACT

The invention relates to a method of controlling a lighting system with multiple controllable light sources 3*a*, 3*b* and a system therefor. According to a first aspect, influence data of the lighting system are obtained, which data represent the effect of one or more of the light sources 3*a*, 3*b* on the illumination of one or more sections of an illuminated environment. In an optimization method, sets of control commands are continuously determined, a predicted light distribution for these control commands is determined from the influence data, and a colorimetric difference between the predicted light distribution and a target light distribution is determined. A plurality of adjustment steps are performed to minimize the colorimetric difference. According to a second aspect, a neural network is trained with the influence data and a set of control commands for controlling the lighting system is determined with the use of the neural network.

10 Claims, 4 Drawing Sheets

U.S. PATENT DOCUMENTS

| | | | | |
|---|---|---|---|---|
| 2003/0062413 | A1 | 4/2003 | Gardiner et al. | |
| 2005/0174473 | A1 | 8/2005 | Mortgan et al. | |
| 2005/0248299 | A1 | 11/2005 | Chemel et al. | |
| 2005/0275626 | A1 | 12/2005 | Mueller et al. | |
| 2006/0076908 | A1 * | 4/2006 | Morgan et al. | 315/312 |
| 2008/0088244 | A1 * | 4/2008 | Morishita | 315/154 |

OTHER PUBLICATIONS

Xiao-Fan Feng et al; "Vision-Based Strategy to Reduce the Perceived Color Misregistration of Image-Capturing Devices", Proceedings of the IEEE, IEEE, New York, US, vol. 90, No. 1, pp. 18-27 Jan. 2002, XP011044600.

Keechul Jung et al; "Text Information Extraction in Images and Video: A Survey", Pattern Recognition, Elsevier, Kidlington, GB, vol. 37, No. 5, May 2004, pp. 977-997, XP004496837.

Lawson et al: "Solving Least Squared Problems"; Prentice-Hall 1974, Chapter 23, p. 161.

Stone, M.: "Representing Colors As Three Numbers"; Tutorial, Publised by IEEE Computer Society, Jul./Aug. 2005, pp. 78-85.

Robertson, A.: "Computation of Correlated Color Temperature and Distribution Temperature"; Journal of the Optical Society of America, vol. 58, No. 11, Nov. 1968, pp. 1528-1535.

Sharma et al: "Color Imaging for Multimedia"; Proceedings of the IEEE, vol. 86, No. 6, Jun. 1998, pp. 1088-1108.

Johnson et al: "A Top Down Description of S-CIELAB and CIEDE2000"; 2003 Wiley Periodicals, vol. 28, No. 6, Dec. 2003, pp. 425-435.

Akos Borbely et al; "The Concept of Correlated Colour Themperature Revisited", Color Research & Application, vol. 26, No. 6, pp. 450-457, 2001.

K. Wnukowicz et al; "Colour Temperature Estimation Algorithm for Digital Images Properties and Convergence", Opto Electronics Review, vol. 11, No. 3, pp. 193-196, 2003.

* cited by examiner

METHOD OF CONTROLLING A LIGHTING SYSTEM BASED ON A TARGET LIGHT DISTRIBUTION

This application is a national stage application under 35 U.S.C. §371 of International Application No. PCT/IB2007/052323 filed on Jun. 18, 2007, and published in the English language on Jan. 3, 2008, as International Publication No. WO/2008/001259, which claims priority to European Application No. 06116229.3 filed on Jun. 28, 2006, incorporated herein by reference.

The invention relates to a method of controlling a lighting system with multiple controllable light sources and a system therefor.

Lighting systems with controllable lighting units, which are controllable by a control unit, are being used today for office and commercial applications and will rise in significance in the near future. For mid- and long-term office and commercial lighting, it is anticipated to adopt new light sources that will offer a broad scope of new capabilities to the user, in terms of color, brightness level, beam directionality, beam shape, beam pattern, or dynamic effects. This enhanced functionality and flexibility in generating indoor light effects will result in a higher level of freedom for designing lighting scenarios. On the other hand, also the number of parameters of the light sources which have to be set is dramatically increased, which leads to a more complex set-up and operating procedure. In this context of advanced lighting infrastructures, a need exists to control a lighting system automatically and to set the lighting system to a desired target light distribution.

An approach to solve this problem is disclosed in US 2002/0015097 A1. The document discloses a lighting control device which is able automatically to control a lighting system in a room in dependence on environmental conditions, i.e. sunlight, presence of human beings, and additional light sources. The lighting control device contains a sensor capable of producing an electronic image of the room. Control means are able to control the lighting system in response to the measured radiation values taken from the electronic image, in accordance with a predefined brightness level.

The disclosed lighting control device does provide an automatic control, but it is not possible to set the lighting system automatically to a desired lighting scenario given by a user. Accordingly, it is an object of this invention to provide a method and a system for controlling a lighting system with multiple controllable light sources which provides an automatic control based on a desired target light distribution.

The object of this invention is solved by the methods of controlling a lighting system with multiple controllable light sources and systems for controlling a lighting system according to claims. Dependent claims relate to preferred embodiments of the invention.

To operate the lighting system, a set of control commands is used. The invention enables the automatic generation of control commands for controlling light sources of a lighting system, based on a target light distribution given by the user. It is thus advantageously not necessary to set each parameter of each involved controllable light source manually. The user only needs to define a target light distribution, which is in the context of the present invention understood to comprise any representation of the desired lighting scenario to be applied to an environment, for example a room. The target or desired lighting scenario may comprise any lighting effect and thus, for example, areas with different colors and brightness values. The target light distribution may be in the form of any suitable representation, for example a color bitmap, an array of numerical values, or vectors. The target light distribution may be designed by means of a suitable design apparatus, for example a computer with a lighting design software. The system according to the invention then automatically generates a suitable set of control commands for the lighting system on the basis of the target light distribution.

The light sources may be of any suitable type, for example commercially available halogen, CDM, HID, UHP, OLED, or LED lighting units. At least one parameter of each light source is controllable. This may be the on/off state of the respective light source in the simplest case. Preferably, the light sources are also controllable in terms of the brightness of the emitted light, i.e. dimmable. Most preferably, the light source or groups of light sources generate light in multiple colors, such that also the color of the emitted light is controllable. For example, an array of colored high-power LEDs may be used here. Moreover, moving-head lighting units may also be considered.

Generally, a set of control commands comprises commands which set parameters of the controllable light sources to defined values. Although all parameters of the controllable light sources may be addressed, it is not necessary that a set of control commands addresses all light sources or even all parameters of a single light source. For example, in a lighting system installed in a large room, for example a department store, the user may only want to set the light distribution for a limited area of the department store, and thus the control commands only need to address the controllable lighting units installed in this area of the room.

For determining a suitable set of control commands according to a first aspect of the invention, the method comprises an optimization procedure with a number of steps.

In a first step for determining a suitable set of control commands, influence data are obtained which represent the effect of one or more of the light sources on the illumination of one or more sections of the illuminated environment. In the context of the present invention, a section may be any spatial part of the illuminated environment, for example a point in the environment, a spot of light, a small area, or even a special sales area, for example in a department store.

Within the context of influence data, the term "effect" of the light sources may refer to any measurable value describing the impact of light sources on objects (e.g. reflecting walls) within the observed space. In a simple embodiment, this may be a geometric brightness distribution, describing only the intensity of illumination of a certain object or area by a light source. Also, there may be spectral information, preferably relating to color, but not necessarily limited to the visible range. Generally, the effect may be written as p(x, y, z, lambda), where p is the power distribution measured at a geometric location x, y, z and lambda is the wavelength. Preferably, color information may be given as RGB or RGBE data.

It should be noted that, while it is preferable that the target light distribution and the measured effect should be in the same format (i.e. preferably comprise the same parameters measured at the same locations), this is not necessarily the case.

The influence data may thus be formed by any type of information which renders possible a mapping between at least one control command and the effect of the control command on the lighting system and the illuminated environment.

To find a suitable set of control commands capable of generating the target lighting scenario, a first set of control commands is determined. This may be considered as a "first guess" for controlling the lighting system according to a given target light distribution. The first set of control commands may be based on previous target light distributions or simply be set to generally defined values, for example in terms of brightness, to a brightness of 50%. Various preferred methods for determining the first set of control commands are described below.

Using the influence data explained above, it is possible to determine a predicted light distribution for a given set of control commands, here for the first set of control commands. This predicted light distribution is then compared with the target light distribution.

According to the invention, a colorimetric difference between the predicted light distribution and the target light distribution is determined. It is thus advantageously determined how close the predicted light distribution, set according to the first set of control commands, is to the desired target light distribution. On the basis of the result of this determination, a new set of control commands is determined. Such a procedure may be referred to as an iterative operation.

The colorimetric difference refers to one or more values, which define a measure of how closely the predicted light distribution matches the desired or target light distribution. The colorimetric difference used should thus provide a measure of how different two colors are perceived by the human eye. The term "colorimetric difference", therefore, presupposes a calculation of a color difference and/or a difference in correlated color temperature.

A color difference between two points may be calculated according to standard equations known to those skilled in the art and suitable for determining the colorimetric difference between two points, for example CIE 94, BFD, AP, CMC or CIEDE 2000, of which the CIEDE 2000 equation is especially preferred. Whenever images are used to describe light distributions, further filtering or other processing may be applied to the light distributions prior to the determination of the colorimetric difference, as will be explained in detail below.

From the calculated color difference and/or difference in correlated color temperature, which is preferably performed over a plurality of locations, it is possible to calculate an overall criterion for the colorimetric difference.

Once this criterion describing the difference between the predicted light distribution and the target light distribution has been determined, it is decided on the basis of the outcome of this determination whether a further optimization of the set of control commands is necessary. To optimize the set of control commands even further, a plurality of adjustment steps are conducted to minimize the colorimetric difference. The adjustment steps each include the determination of a new set of control commands, the determination of a resulting predicted light distribution for said new set of control commands using the influence data, and the determination of the colorimetric difference between the predicted light distribution and the target distribution. Each step is conducted in a manner analogous to the one mentioned above. Further adjustment steps may apply if the difference between the predicted light distribution and the target light distribution is not sufficient.

Several algorithms may be used to optimize the color difference in the iterative method according to the invention. Generally a multi-dimensional, multi-objective optimization method (vector optimization) is necessary to minimize the colorimetric difference. Such methods are per se known in the art. Especially preferred methods include gradient-based methods and genetic algorithms. An example of a gradient-based method may be NBI (normal-boundary intersection), which can be utilized to obtain the most suitable solution. Naturally, the invention is not limited to the above-mentioned optimization methods. Criteria for the optimization may be, for example, a least square criterion (i.e. to minimize the square root of the sum of the squared computed colorimetric differences between the predicted and the target light distributions) or to minimize (in a Pareto sense) the mean value of the computed colorimetric differences and the average of the mean value of those computed colorimetric differences which are higher than the $95^{th}$ percentile value.

The influence data may be obtained from a detection step, a suitable database, or manual input. It is especially preferred that the influence data are obtained from at least one detection step in which each of the light sources is operated according to a plurality of parameter values and the impact of each parameter on the one or more sections of the illuminated environment is detected. In each detection step, a set of photometric data is obtained which represents the impact of the one or more parameters of the respective light sources.

In the above-mentioned detection steps, suitable detectors may be used for the initial set-up of the lighting system. They are not used for further operation.

According to a second aspect of the invention, a set of control commands for controlling the lighting system is determined by means of a neural network. The neural network is trained with the use of the influence data obtained, for example, as explained above. Within the second aspect, an iterative procedure as described above is not necessary, which provides a very fast determination of a set of control commands. On the other hand, no validation of the determined set of control commands is conducted.

Therefore, to obtain the advantages of both the first and the second aspect of the invention, the method according to the second aspect of the invention may also be utilized for determining the first set of control commands by the method according to the first aspect of the invention as described above. This optimization may be significantly faster within the adjustment steps in this case, since the first set of control commands, determined according to the second aspect of the invention, may already supply a light distribution which is very close to the desired light distribution.

The neural network may be, for example, an artificial neural network (ANN), wherein the influence data are used as training sets, and the set of control commands constitutes the output of the ANN. In this case, the ANN is trained to translate a set of control commands into a predicted light distribution. The influence data are used to generate input neurons.

It is preferred that the target light distribution comprises boundary conditions for the parameters of the one or more lighting units of the lighting system. The boundary conditions comprise at least one or more of: maximum allowed power consumption, minimum mean value of the illuminance, minimum required luminous efficacy, a set of possible values for each parameter (e.g. the number of discretization steps per channel, such as 8-bit or simply on-off) average range of the color rendering index (CRI), boundary values for correlated color temperature (CCT) or minimum color harmony index (HRI), although the invention is not limited hereto. Included in the target light distribution, these boundary conditions are to be considered in determining a suitable set of control commands. Alternatively, within the first aspect of the invention, any vector optimization may encompass power consumption and luminous efficacy as performance standards instead of boundary conditions.

In a preferred embodiment of the invention, the determination of the colorimetric difference comprises the transformation of the predicted light distribution and the target light distribution to a perceptually uniform color space. This preferred embodiment provides that the calculated colorimetric differences are independent of the absolute color of the points compared. This perceptually uniform color space may be non-linear, such as CIELAB or other applicable color spaces. In a further preferred embodiment, a transformation into a linear color space is effected. This renders possible an advantageous direct addition of the tri-stimulus values of the relevant light sources to obtain a set of control commands which matches the target light distribution. Examples of suitable color spaces include linear RGB, RGBE, and CIE XYZ. The use of a linear color space is especially advantageous in determining the predicted light distribution by the matrix-inversion explained above. Influences by non-system light sources can also be considered if a linear color space is used.

It is preferred that the predicted light distribution and the target light distribution are filtered by means of a spatial filter function prior to the determination of the colorimetric difference. The use of a spatial filter advantageously enhances the determination of the colorimetric difference between the predicted light distribution and the target light distribution. Since the colorimetric difference is to be determined as closely as possible to the difference in light distributions as perceived by the human eye, those image components that cannot be seen by the human eye are removed, whereas the most representative ones are enhanced. It is especially preferred that the spatial filter resembles the contrast sensitivity function (CSF) of human vision. Details of the CSF can be found in G. M. Johnson and M. D. Fairchild, "A top down description of S-CIELAB and CIEDE2000", Color Research and Application, 28(6):425-435, December 2003.

Further filters may be added to or replace the filter mentioned above prior to the determination of the colorimetric difference, for example a filter which resembles the color visual difference model (CVDM) as explained in E. W. Jin, X. F. Feng and J. Newell "The development of a colour visual difference model (CVDM)", IS&Ts 1998 Image Processing, Image Quality, Image Capture, Systems Conf., pages 154-158, 1998).

To apply the spatial filter, the light distributions are preferably trans-formed into an opponent color space featuring one luminance and two chrominance dimensions.

When describing a light distribution in terms of a photometric data set, the colorimetric difference can be easily determined by comparing all data points of the light distribution. This approach may lead to a long computation time and thus may be inefficient.

To avoid high computational efforts, it may be advantageous to apply a segmentation processing step prior to the determination of the colorimetric difference. It is therefore preferred to conduct a segmentation prior to the determination of the colorimetric difference. The segmentation comprises the determination of representative values of the target light distribution and/or the predicted light distribution, which are characteristic of the associated sections of the environment to be illuminated or of the respective light distribution. The determination of the colorimetric difference between the predicted light distribution and the target light distribution is then limited to the representative values, thus reducing the computational time.

The clear benefit associated with this segmentation step is the reduction of the number of data points for which the color difference has to be determined. Both light distributions, the predicted light distribution and the target light distribution, may be segmented, but is sufficient to segment only one of the light distributions, as long as a defined mapping from one pixel value of the first light distribution to the other one is ensured.

In a preferred embodiment of a segmentation method, the light distribution is divided into smaller regions, for example using a regular rectangular grid. Then a number of colorimetrically characteristic pixels are identified for every subregion of the grid.

In a further embodiment of a segmentation method, the light distribution is segmented on the basis of the color distribution within the respective light distribution. Here, the light distribution is segmented in sections which show a certain color homogeneity. For these sections, one or more representative values are chosen, representing said certain color.

In another preferred embodiment of a segmentation method, the light distribution is segmented on the basis of sections of the illuminated environment which are characterized by the impact of a certain light source.

Naturally, a combination of the above segmentation methods is also possible. The segmentation methods described above should be carefully chosen, depending on the respective application, since every segmentation leads to an inherent reduction of information which may lead to a loss of quality of the set of control commands which trigger the target light distribution.

In a system for controlling a lighting system comprising one or more controllable lighting units, connected to control means, the control means are designed to obtain influence data of the lighting system which represent the effect of one or more of said light sources on the illumination of one or more sections of the illuminated area. The control means are further designed to determine a first set of control commands, to determine a predicted light distribution for said first set of control commands from said influence data, to determine a colorimetric difference between said predicted light distribution and a target light distribution, and to apply a plurality of adjustment steps to said set of control commands in order to minimize said colorimetric difference. A new set of control commands is determined, a predicted light distribution for said new set of control commands is determined from said influence data, and said colorimetric difference is determined in each step.

To control each parameter of the respective lighting unit, the lighting units are connected to control means. The term "connected" in the context of the present invention is understood to include all suitable kinds of control connections, either wireless or wired, which render it possible to set the controllable parameters of the respective lighting unit. The control connection may be formed, for example, by a simple controllable relay. Preferably, an electrical control connection is used, for example a wired DMX (USITT DMX512, USITT DMX512/1990) connection or a LAN connection. Most preferably, a wireless control connection is used, which advantageously reduces the installation time. The wireless control connection may be established, for example, using ZigBee (IEEE 802.15.4), WLAN (IEEE 802.11b/g), Bluetooth, or RFID technology, which are commercially available.

The control means may be any type of suitable electric or electronic circuit. For example, the control means may be a logic circuit, a microprocessor unit, or a computer. The control means implement the method to obtain a set of control commands as described above.

The influence data may be obtained from database means or by manual input. It is preferred that the system further comprises detector means connected to the control means by a suitable connection, as mentioned above. The detector means obtain the influence data from the lighting system by operating each light source according to a plurality of parameter values in one or more detection steps. The impact of each parameter on the one or more sections of the illuminated environment is detected. In each detection step, a set of photometric data is obtained which represent the impact of the one or more parameters of the respective light sources.

The detector means may comprise a suitable sensor, for example a CCD sensor. The detector means should be able to detect the effect of the light sources on its position. Any of the above parameters of this effect can be measured by the sensor. For example, the CCD sensor may simply measure intensity. Depending on filters placed on the CCD, the sensor may measure RGB, RGBE, or other colors. If the CCD is fitted with narrow-band filters, it may also carry out quasi-spectral measurements.

Depending on the room size where such a programming system is applied, the detector means preferably comprises more than one sensor to obtain an overall large monitoring area. Naturally, the positions of the detector means in the respective environment should be kept constant during the operation of the lighting system.

The invention will be explained in detail below with reference to the figures, in which FIG. 1 shows an embodiment of a system for controlling a lighting system, installed in a room;

Figure 1:
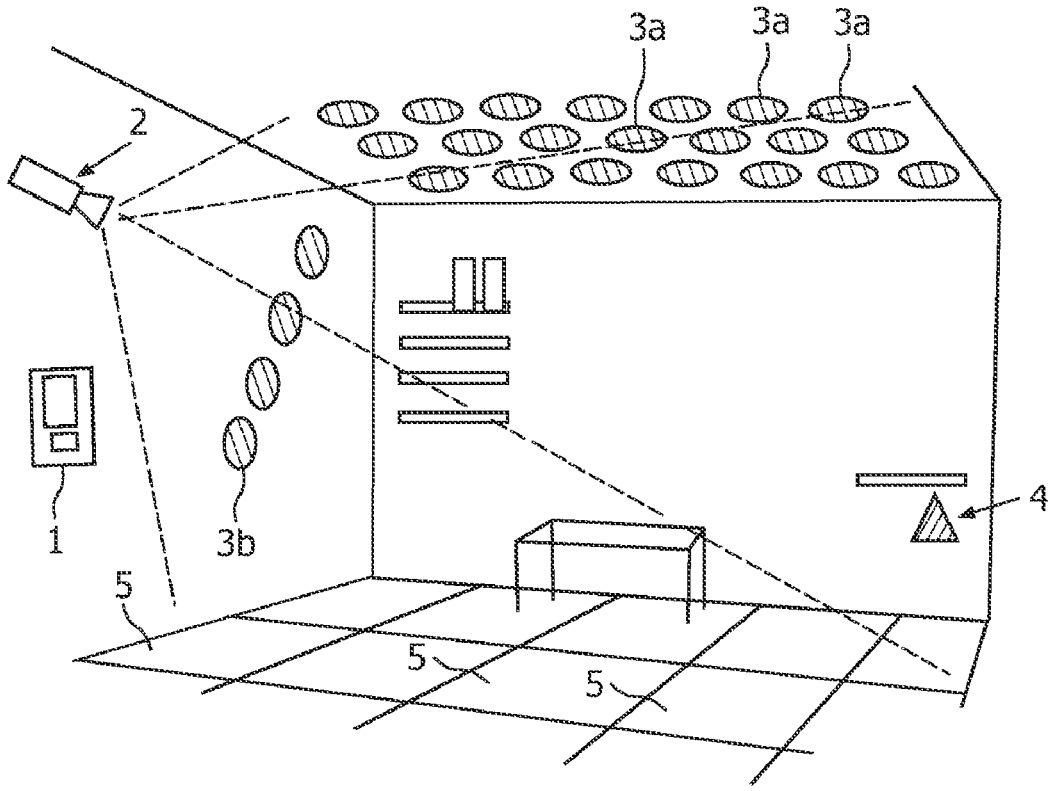

FIG. 1 shows an embodiment of a system for controlling a lighting system according to the invention. The system comprises several light sources 3*a*, 3*b*, which are arranged to illuminate sections 5 of a room. While the light sources 3*a*, placed at the ceiling of the room, are mainly used to illuminate the room, the light sources 3*b* are arranged for special lighting effects, i.e. architectural lighting. The light sources 3*a*, 3*b* are connected to a control and interface unit (CUI) 1 by DMX 512 connections. The CUI 1 is provided for interaction with the user. The CUI 1 comprises a display with a graphical interface, which allows the user to enter a desired target light distribution which is to be applied to the room by the light sources 3*a*, 3*b*. The CUI 1 further comprises a processor unit which determines suitable control commands corresponding to the target light distribution for a set-up and also controls the system.

The system comprises a CCD camera 2 to obtain influence data which reflect the impact of each parameter on the one or more sections 5 of the room. The CCD camera 2 observes the complete room, as indicated by the broken lines in FIG. 1. Further cameras 2 may be used to obtain influence data from different viewpoints, especially in large rooms. Other sensors 4 may be used, such as daylight or scattered-light sensors, to compensate for any effect on the desired target light distribution.

A set of control commands for controlling the lighting system is determined on the basis of an optimisation so as to obtain the desired target light distribution according to a first aspect of the invention.

Figure 2:
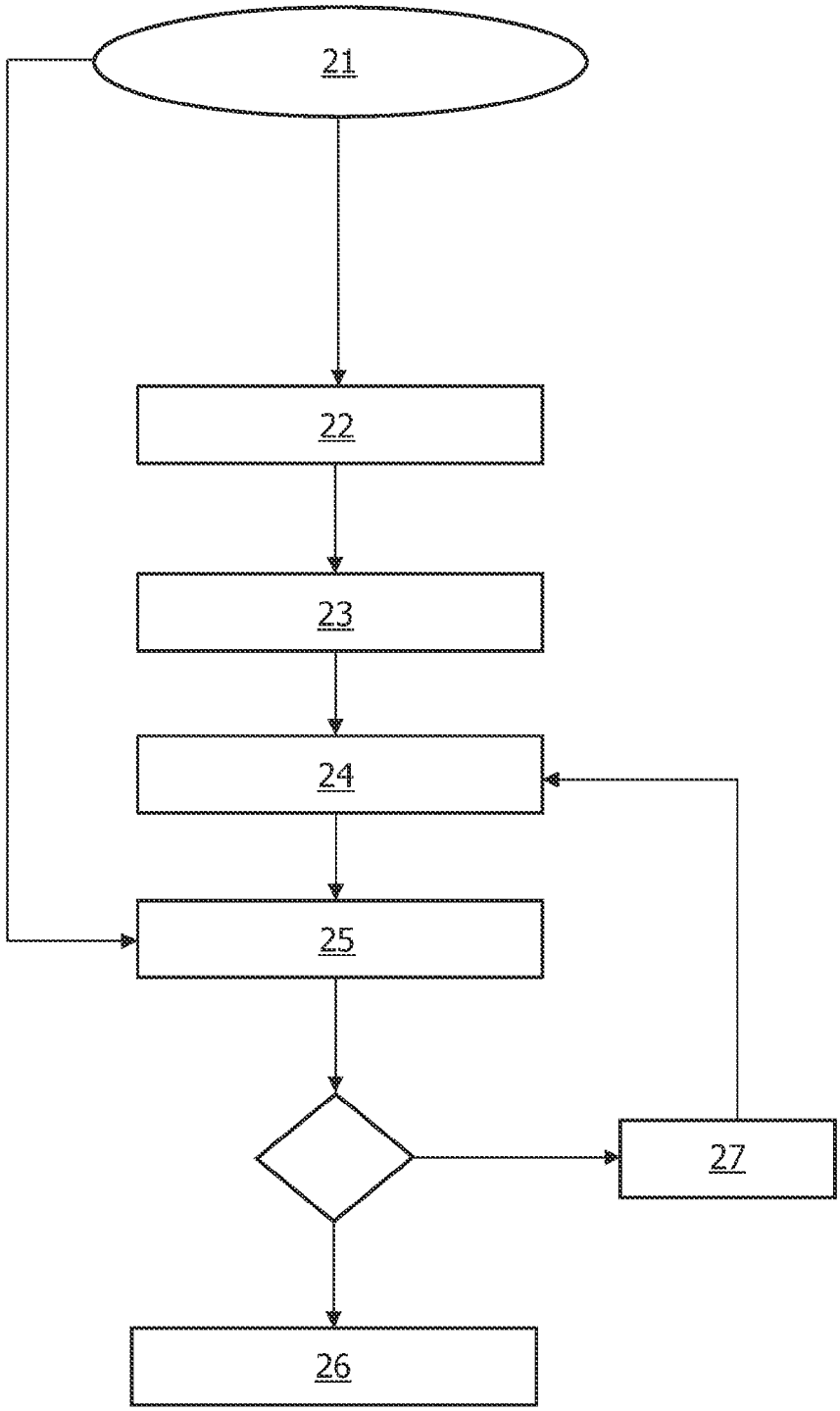
FIG. 2 shows a first embodiment in a schematic diagram of a method, according to a first aspect of the invention.

FIG. 2 shows the sequence of operations of a first embodiment according to a first aspect of the invention. Initially, the user defines the desired target light distribution 21, for example using the graphical interface of the CUI 1 shown in FIG. 1. It is alternatively possible to obtain the target light distribution 21, for example, from a database.

In step 22, influence data of the lighting system are obtained, which data represent the effect of one or more of said light sources on the illumination of one or more sections of an illuminated environment. Having the influence data, it is possible to form a model of the lighting system and to determine the effect of a set of control commands.

To obtain the influence data, an exemplary method may include that an image of the room is taken with all light sources being switched off. As explained above, the image may be taken by a CCD sensor 2, photo sensor, etc. Then a specific lighting unit is switched, driven in accordance with a defined configuration, and a further image is taken. The impact of the specific light source can then be determined from a comparison between the two images (before/after), and a set of photometric data is generated. Such a heuristic method will have to be applied to all light sources in the lighting system and for every parameter setting of each respective light source. Each set of photometric data then represents one specific setting, i.e. a set of values for the controllable parameters for each light source, for example color, dimming level, light pattern, etc. To allow an addition of the light of different light sources, the influence data must be determined in a linear color space, for example linear sRGB. Alternatively, it is possible to obtain the influence data from a database or from a manual input by the user.

In step 23, a first set of control commands for controlling the lighting system is generated, based on the target light distribution. The first set of control commands can be considered as a "first guess" for controlling the lighting system, as mentioned above. The first set of control commands may be chosen, for example, from a database in which some standard light distributions are stored. In this case a light distribution of the database is chosen which is close to the target light distribution. The first set of control commands may further be determined by the method according to a second aspect of the invention as explained below. Naturally, the invention is not limited hereto.

Having the influence data, it is possible to determine a predicted light distribution for said first set of control commands. This is done in step 24.

Generally, most target light distributions imply a mixing of light of the respective light sources in a lighting system with multiple light sources.

According to the near-linearity of human color perception, summarized by Grasmann's law of additive color mixing for linear color spaces, the color resulting from combining several colored light sources can be predicted as the sum of the tri-stimulus values of the respective light sources taken separately $$K_1(x, y) = \sum_{i=1}^{N} K_{1,i}(x, y)$$

$$K_2(x, y) = \sum_{i=1}^{N} K_{2,i}(x, y)$$

$$K_3(x, y) = \sum_{i=1}^{N} K_{3,i}(x, y)$$

wherein $K_m$ refers to the $m^{th}$ tri-stimulus value in the respective linear color space, x,y are co-ordinates of the data point, and i refers to the $i^{th}$ light source of the lighting system.

Thus, it is possible to calculate the impact of multiple light sources on sections of the illuminated room by summing the tri-stimulus values of each light source. Accordingly, when obtaining information on the impact of each parameter of the light sources on the illuminated room, it is possible to determine the distribution which will apply when multiple lighting units are operated simultaneously (i.e. predict what it will look like).

In the calibration step, a vector or matrix Ik is determined holding the $k^{th}$ base image/photometric measurement resulting from this calibration step. A spatial filtering (CVDM or S-CIELAB) is applied to Ik. Ik is expressed in a device-independent color space. Such digital pictures are normally stored as Xr×Yr×3 matrices holding Nb-bit values (where Nb is the color depth).

According to Grassman's Law, the predicted light distribution can be computed with the expression $$\tilde{I} = I_{pred}(\{\alpha_k\}_{k\in\Omega}) = \sum_{k\in\Omega} I_k$$

Then, the predicted light distribution is transformed from a linear light device independent color space to the CIE Lab color space according to $$\tilde{J} = {}_{dev\ indep}T^{CIE\ Lab}\{\tilde{I}\}.$$

The same is done with the target light distribution $$J_{target} = {}_{dev\ indep}T^{CIE\ Lab}\{I_{target}\}.$$

In the following step 25, a colorimetric difference is calculated between the target light distribution 21 and the predicted light distribution as determined in step 24. The details of step 25 are explained below.

If the colorimetric difference calculated in step 25 is sufficiently small, the method ends. The predicted light distribution may then be applied to the lighting system in step 26.

If that the colorimetric difference is too large, further optimization is carried out. The values for the controllable parameters are then adjusted in an adjustment step 27, and the above steps are repeated. The "iterative loop" thus formed is continued until the colorimetric difference is sufficiently low or cannot be further reduced.

As mentioned above, a multi-dimensional optimisation method (vector optimisation) is generally conducted to minimize the colorimetric difference. In a first example, a gradient-based method with a least square criterion is utilized to obtain a suitable set of control commands. Such methods are known per se to those skilled in the art. A possible approach is described, for example, in: Lawson, C. L. and R. J. Hanson, Solving Least Squares Problems, Prentice-Hall, 1974, Chapter 23, p. 161. As will be further explained, the optimization may additionally be multi-objective, i.e. aimed at optimizing not only the colorimetric difference as a single criterion, but also other criteria such as minimized power consumption, maximized luminous efficacy, etc.

As mentioned above, the light distributions may be represented by numerical vectors. These vectors may be formed by the tri-stimulus values of respective points in the room in which the lighting system is installed. For example, the CCD sensor 2 shown in FIG. 1 may form a pixel image, wherein each pixel represents a respective point.

When determining the colorimetric difference, the target light distribution and the predicted light distribution are compared. This is achieved by comparing the respective data points of the two light distributions in terms of color difference. For this purpose, the two light distributions should match, i.e. a data point in the target light distribution and in the predicted light distribution should refer to the same "real" point in the room. For example, if both light distributions are formed by images, the images should be taken from the same viewing angle and with the same pixel resolution. If the two light distributions do not match, a mapping is necessary.

The color difference may be calculated for each data point using, for example, one of the following equations: CIEDE 2000, CIE94, BFD, AP or CMC. To determine the colorimetric difference of the overall light distribution, the mean value of the color difference of all data points is calculated. A technical description of the S-CIELAB and the CIEDE 2000 equations can be found in the following documents: G. M. Johnson and M. D. Fairchild, "A top down description of S-CIELAB and CIEDE2000", Color Research and Application, 28(6):425-435, December 2003; G. Sharma, M. J. Vrhel and H. J. Trussel, "Color imaging for multimedia", Proceedings of the IEEE 86(6):1088-1108, June 1998; M. C. Stone, "Representing colors as three numbers", IEEE Computer Graphics and Applications, 25(4):78-85, July-August 2005.

Figure 3:
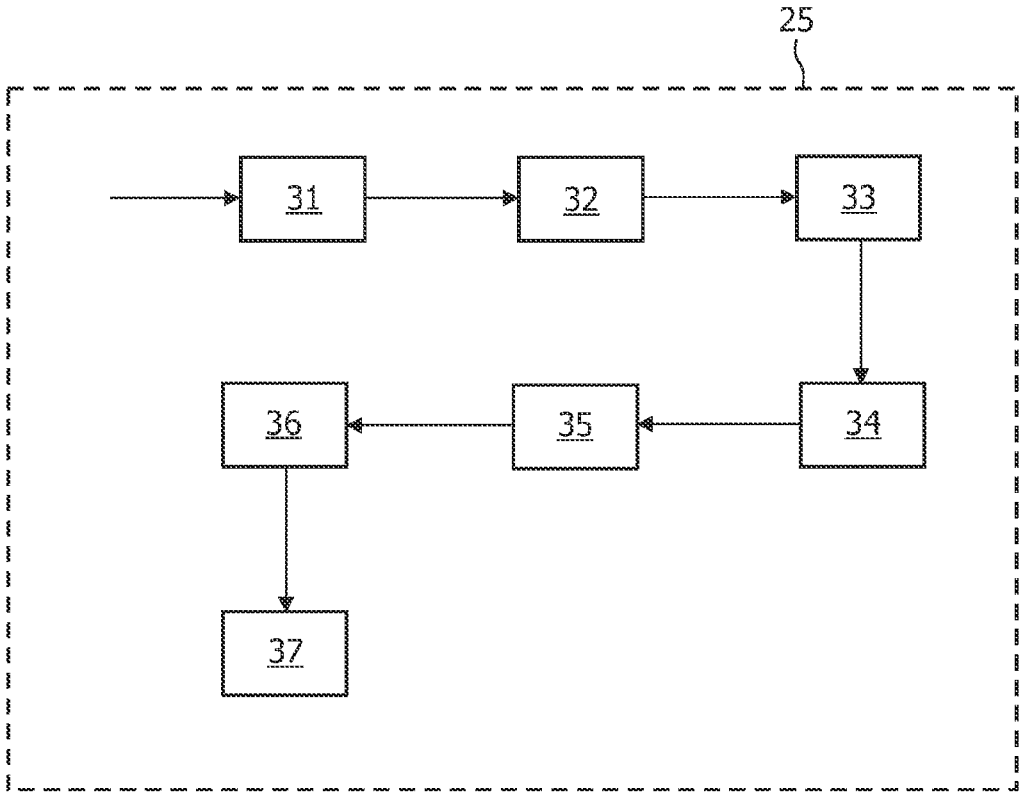
FIG. 3 shows a detailed diagram of the step of determining the colorimetric difference according to the embodiment shown in FIG. 2.

To obtain suitable results when calculating the colorimetric difference, step 25 may include several pre-processing steps shown in FIG. 3. This pre-processing has to be applied to both light distributions. First, the light distributions are transformed into a device-independent color space in step 31 to achieve comparability between the two light distributions. The device-independent color space may be chosen from among sRGB, LMS, and CIE XYZ.

Then, in step 32, the two light distributions are transformed into an opponent color space featuring one luminance and two chrominance dimensions.

Prior to this, the light distributions are individually filtered in step 33, for which spatial filters are used which resemble the contrast sensitivity function (CSF) of human vision. Here, components of the light distributions that cannot be seen by the human eye are removed and the most representative ones are enhanced. These components may be, for example, specific colors. This spatial pre-processing allows the subsequent determination of colorimetric difference to account for complex color stimuli and human spatial and color sensitivity.

Alternatively or additionally to a filtering step using the contrast sensitivity function, one may use the color visual difference model (CVDM) to filter the light distributions. The CVDM is described in detail in X. F. Feng and S. Daly "Vision-based strategy to reduce the perceived colour misregistration of image-capturing devices", Proceedings of the IEEE, 90(1):18-27, January 2002.

The filtered light distributions are then transformed into the CIELAB color space in step 34. This color space is a more uniform color space than the prior one, i.e. similarly perceived differences in the appearance of the light distributions yield similarly computed magnitudes of colorimetric difference, thus providing a better match with color differences as viewed through a human eye.

After transformation, the light distributions are segmented in step 35. As mentioned above, the segmentation comprises a determination of representative values of the target light distribution and/or the predicted light distribution. The representative values are characteristic of associated sections of the respective light distribution.

In an exemplary segmentation method, the light distribution is divided into smaller regions, for example using a regular rectangular grid. For example, the light distribution is divided into sections 5, as explained with reference to FIG. 1. Then a number of colorimetrically representative data points are identified for every sub-region of the grid. The data points of each section are combined into clusters for this purpose. A choice for the components may be the tri-stimulus values of the data points, for example the RGB values or alternatively any other colorimetric triplet such as, for example, the X, Y, and Z coordinate values in a CIE XYZ color space, or still other colorimetric magnitudes such as lightness, chroma, and psychometric saturation, etc.

Many alternative methods are known in the art to perform the above-mentioned clustering step. For example, Lloyd's algorithm, Fuzzy c-means, or neural gas may be applied as clustering steps. Once a sensibly low number of clusters have been identified, one representative data point should be chosen for every cluster, for example one of the data points evaluated on the colorimetric and location components that is closest, in terms of Euclidean distance, to the centre of the cluster it belongs to. Alternatively, such a representative data point may be a randomly chosen member of the cluster. The clear benefit associated with this segmentation step is the reduction of the number of data points for which the color difference has to be determined.

Both light distributions, the predicted light distribution and the target light distribution, may be segmented, but is sufficient to segment only one of the light distributions, as long as a defined mapping from one data point of the first light distribution to the other one is ensured.

Subsequent to the segmentation, the color difference between the respective data points of the light distributions is determined in step 36.

The matrix (vector) of color differences between the predicted and the intended light distributions is computed (pixel-wise) according to CMC, CIE 94, CIE DE2000 or the like $$\Delta I = \text{colour difference}(\tilde{J}, \tilde{J}_{target}) = [\delta i_{ij}].$$

From this color difference vector, a criterion is then calculated serving as a measure of how closely the predicted color distribution is perceived to lie with respect to the target distribution.

There are several possible ways to calculate such a criterion. In a simple approach, a mean value of the color differences over all data points may be determined in step 37. This single criterion may then be optimized in a multi-dimensional, single-objective optimization method.

However, it is preferred to calculate the criterion in better suited way using a weight function. This weight function $w_{ij}$ has a weight factor for each location i, j so that some locations may be emphasized (larger w) or the influence of some locations could be limited (small w), or even suppressed (w=o). It is further preferred to use not just one criterion, but to calculate more and then to use a multi-dimensional, multi-objective optimization method.

The mathematical problem to be solved may be described by a pair of objective functions. In the present example, the first criterion (objective function) is the mean value of the color differences between the two light distributions (weighted measurement point, possibly dependent on the relevance of the area). The second criterion (objective function) is defined as the mean of the same values, which are higher than or equal to the $95^{th}$ percentile of the color difference values in the matrix:

$$\min_{\{a_k\}} \begin{bmatrix} avg(w_{ij}\delta i_{ij}) \\ avg(w_{ij}\delta i_{ij} > \delta i_{95}) \end{bmatrix}.$$

The aim of the optimization is to compute the composition that minimizes both these criteria in the Pareto sense.

The multi-dimensional, multi-objective and the multi-dimensional, single-objective optimization can both be solved through genetic algorithms or NBI (Normal-Boundary Intersection) methods known to those skilled in the art.

In an alternative embodiment, the criteria for colorimetric difference may further include the correlated color temperature. In the following example, a target distribution expressed in terms of correlated color temperature (CCT) is intended to be rendered/displayed on/over a certain work surface in addition to the target light distribution in terms of luminance and chrominance $$T_{target} = [\tau_{ij0}]$$

The CCT can be straightforwardly evaluated from an image or from photometric/colorimetric measurements by means of the so-called Robertson's method (Robertson A. R. Journal on Optics Society of America, 58, pages 1528-1535; G. Wyszecki W. S. Stiles Colour Science Concepts and Methods, Quantitative Data and Formulae, $2^{nd}$ edition, Wiley-Interscience, 1982) or other alternative formulations (A. Borbély, A. Samson, J. Schanda. The concept of correlated colour temperature revisited, Color Research & Application. Volume 26, Issue 6, Pages 450-457, 2001; K. Wnukowicz, W. Skarbek Colour temperature estimation algorithm for digital images—properties and convergence, Opto-Electronics Review, 11(3), pages 193-196, 2003).

$$\tilde{T} = \text{CCT}(\tilde{I}) = [\tilde{\tau}_{ij}]$$

The CCT is estimated pixel-wise, similarly to the way described above for the colorimetric difference, so that a matrix (vector) of Euclidean differences between the predicted CCT results from the predicted linear combination of base images/photometric measurements $$\Delta T = [(\tilde{\tau}_{ij} - \tilde{\tau}_{ij0})^2] = [\delta\tau_{ij}]$$

and the problem can be approximately solved with $$\min_{\{a_k\}} \begin{bmatrix} avg(w_{ij}\delta i_{ij}) \\ avg(w_{ij}\delta i_{ij} > \delta i_{95}) \\ \sqrt{\sum_i \sum_j \delta\tau_{ij}} \end{bmatrix}.$$

Determining an optimization-based set of control commands for controlling the lighting system so as to obtain the target light distribution according to a second aspect of the invention.

A second aspect of the invention deals with how to find a suitable set of control commands without any iterative optimization of the set of control commands. This is achieved by using an artificial neural network (ANN).

Here, the influence data are used as training sets, and the set of control commands is an output of the ANN. The ANN is thus trained to translate a set of control commands into a predicted light distribution. The influence data are used to generate input neurons. The influence data may be written as a numerical matrix. Using the method explained above to obtain the influence data, the relation between a set of control commands, or mathematically a control vector c, and the associated predicted light distribution, which is obtained when operating the lighting system with the set of control commands i, can be written as $$i \approx Jc$$

where J is the influence matrix. The above equation will generally be more of an estimation than an exact equation, hence the "about equal" sign. Using the exemplary detection method explained above, exemplary control vectors C can be described as $[1\ 0\ 0 \ldots 0]^T$, $[0\ 1\ 0 \ldots 0]^T, \ldots, [0\ 0\ 0 \ldots 1]^T$. The pseudo-inverse of the influence matrix $J^+$ can be thought of as a possible model for the impact between the set of control commands and the impact on the illuminated environment. When the matrix is inverted, the equation can be written as $$c \approx J^+ i.$$

Thus the target light distribution can be substituted in the above equation as the vector i, and a control vector c, i.e. a set of control commands for controlling the lighting system in accordance with the desired target light distribution, can be determined by the ANN.

Although the approach explained above may not render it possible to obtain a mathematically exact solution, the ANN can use the approach for determining a predicted target light distribution based on the influence data.

In the present example, the relation between light controls and their effect is assumed to be substantially linear. A simple Multi Adaptive Linear Neuron (MADALINE) architecture may accordingly be assumed. An ANN constructed according to this architecture is then trained using the concept of supervised learning. The required training data for this concept are couples of known in-outputs of the system. This constitutes the above described influence data.

Figure 4:
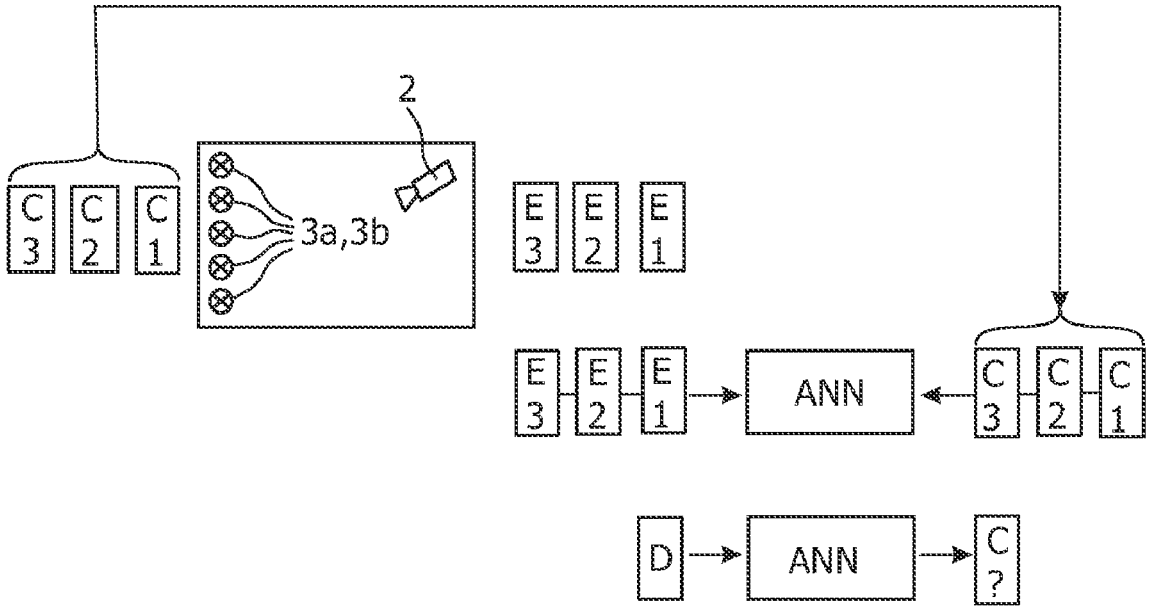
FIG. 4 shows a schematic diagram of steps of a method according to an embodiment of the invention using a neural network.

FIG. 4 illustrates how training data are gathered: Given the system (e.g. room from FIG. 1), with controllable lights 3*a*, 3*b*, reflecting walls, and the sensor device 2 (CCD camera), a set of control vectors ($C_i$) can be applied to the system, and the effects are measured ($E_i$). The effects ($E_i$) and the control vectors ($C_i$) are then used as training data for the ANN, which implements the control system. Once the control system is well trained, it will generate the control vector C, when the input $E_i$ is given. $E_i$ can be seen as a target effect that is obtained by applying $C_i$. Given any desired effect D as an input, the control system will quickly generate a control vector.

This vector may be used as a first guess for the optimization described above. The ANN approach may alternatively be used as a memory that stores known configurations, or as a differential control system that generates adjustments on the control vector, based on differences between a desired and a measured target.

The set of control commands determined according to the present embodiment may also be regarded as the first set of control commands in the embodiment according to the first aspect of the invention, as explained with reference to FIG. 2.

The invention claimed is:

1. Method of controlling a lighting system comprising multiple controllable light sources operated within an environment in accordance with a plurality of parameters, the method comprising:

obtaining influence data of the lighting system representing the effect of one or more of said light sources on the illumination of one or more sections of the environment, determining a first set of control commands, determining a predicted light distribution for said first set of control commands from said influence data, determining a colorimetric difference between said predicted light distribution and a target light distribution, and conducting at least one adjustment step to minimize said colorimetric difference.

2. The method according to claim 1, wherein said influence data are obtained by detecting the effect of at least one parameter from said plurality of parameters on said one or more sections of the environment.

3. The method according to claim 1, wherein said adjustment step comprises an iterative gradient-based optimization.

4. The method according claim 1, wherein said adjustment step comprises an iterative optimization carried out using genetic algorithms.

5. The method according to claim 1, wherein the first set of control commands is determined from a neural network trained with the use of said influence data.

6. The method according to claim 1, wherein said target light distribution comprises boundary conditions for the parameters of the one or more lighting units of the lighting system, said boundary conditions comprising one or more of a maximum allowed power consumption, a minimum mean value of the illuminance, a minimum required luminous efficacy, a set of possible values for each parameter, an average range of the color rendering index (CRI), or a minimum color harmony rendering index (HRI).

7. The method according to claim 1, wherein the determination of the colorimetric difference comprises the transformation of the predicted light distribution and/or the target light distribution to a perceptually uniform color space.

8. The method according to claim 1, wherein the predicted light distribution and the target light distribution are filtered with a spatial filter function prior to the determination of the colorimetric difference.

9. The method according to claim 1, wherein the determination of the colorimetric difference comprises a prior segmentation, said segmentation comprising a determination of representative finite values of said target light distribution and/or said predicted light distribution associated with said one or more sections of the environment, and wherein the determination of the colorimetric difference between said predicted light distribution and said target light distribution is limited to said finite values.

10. The method of claim 1, wherein said adjustment step comprises:

determining a second set of control commands;

determining predicted light distribution for said second set of control commands from said influence data; and determining said colorimetric difference.

* * * * *